US005281172A

United States Patent [19]

Luu

[11] Patent Number: 5,281,172

[45] Date of Patent: Jan. 25, 1994

[54] ELECTRICAL OUTLET ADAPTER

[75] Inventor: Lionel T. V. Luu, Carmel, Ind.

[73] Assignee: Pacomex Industries, Inc., Indianapolis, Ind.

[21] Appl. No.: 985,688

[22] Filed: Dec. 4, 1992

[51] Int. Cl.[5] ..... H01R 13/00

[52] U.S. Cl. ..... 439/651

[58] Field of Search ..... 439/651, 652

[56] References Cited

U.S. PATENT DOCUMENTS

| | | | |
|---|---|---|---|
| 1,717,836 | 6/1929 | Conner | 439/652 |
| 2,761,113 | 8/1956 | Spencer et al. | 439/652 |
| 3,061,716 | 10/1962 | Benander | 439/652 |
| 3,349,363 | 10/1967 | Goodman | 439/652 |

*Primary Examiner*—Joseph H. McGlynn
*Attorney, Agent, or Firm*—Ostrolenk, Faber, Gerb & Soffen

[57] ABSTRACT

The present invention relates to an adapter for converting a single electrical outlet into a multiple electrical outlet. The adapter includes a housing having a front and a back, and two opposed sides extending between the front and back. At least one socket is located on each of the sides. Each socket includes a live prong receiving aperture and a neutral prong receiving aperture. An electrically conductive live bus is disposed in the housing and includes a first live prong capable of being inserted into a live aperture in an electrical outlet. The live bus comprises a pair of electrically conductive first live bus strips, each of which extends along one of the two opposed sides of the adapter and adjacent the live prong receiving aperture of the socket, to electrically conductively engage a second live prong inserted into the live prong receiving aperture. An electrically conductive neutral bus is disposed in the housing and includes a first neutral prong capable of being inserted into a neutral aperture of the electrical outlet. The neutral bus comprises a pair of electrically conductive neutral bus strips, each of which extends along one of the two opposed sides of the adapter adjacent the neutral prong receiving aperture of the socket to electrically conductively engage a second neutral prong inserted into the neutral prong receiving aperture.

32 Claims, 3 Drawing Sheets 110
4
126
124
122
196
4
198
196
198
196
198
108
146
146
148
218
144
118
148
146
150
184
146
144
146
146
136
102
216
140
116
138
140
136
138
172
142
172
138
138
100
136
138
156
154
220
120
156
154
168
152
154
154
168
158
102
154
160
168
152
168
154
132
130
132
128
130
106
132
130
114
128
134
130
132
134
130
132
112
134
130
132
128
134
104

FIG. 7
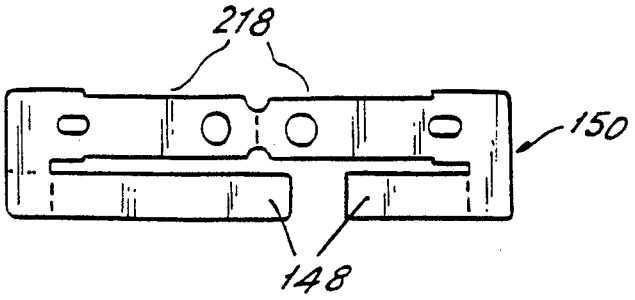
FIG. 6
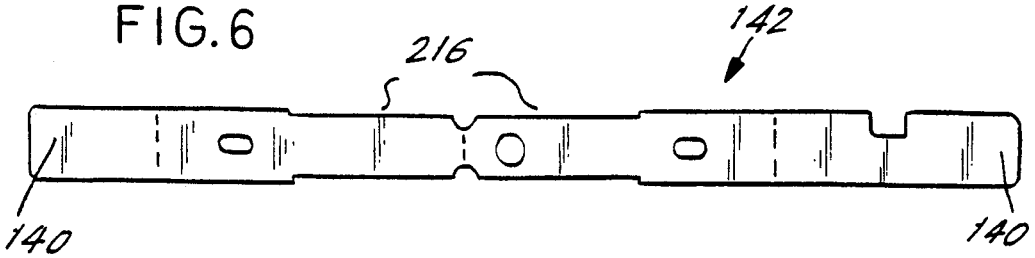
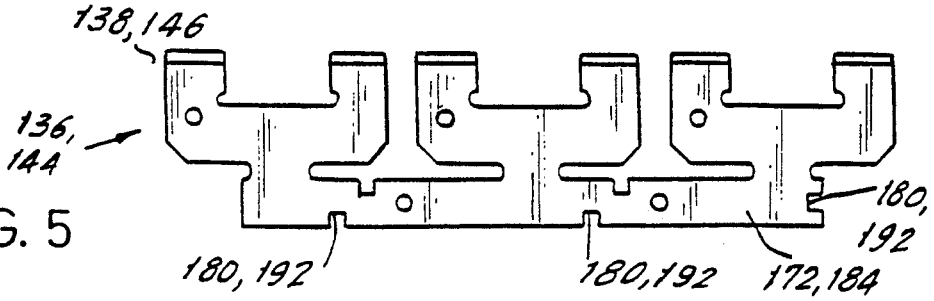
FIG. 5
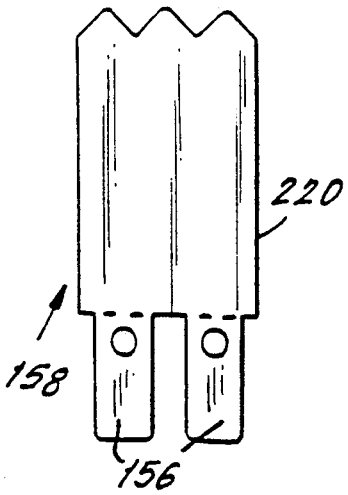
FIG. 9
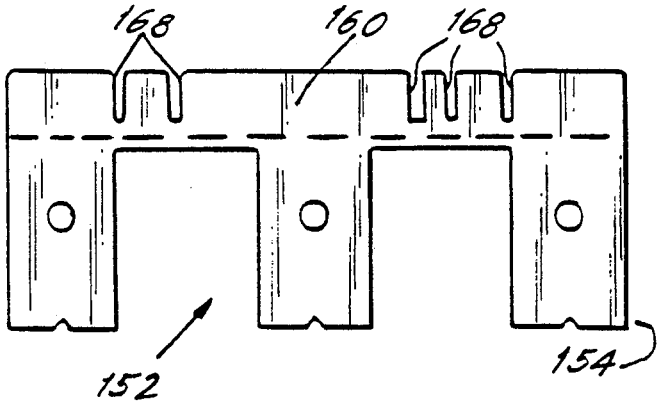
FIG. 8

ELECTRICAL OUTLET ADAPTER

BACKGROUND OF THE INVENTION

1. Field of the Invention

The present invention relates to an adapter for converting a single electrical outlet or current tap to a multiple electrical outlet, such as those used in household and light commercial and industrial applications.

2. Description of the Prior Art

A number of different types of single-to-multiple electrical outlet adapters or current taps are known. There are, for example, the current taps illustrated and described in U.S. Pat. Nos.: 2,792,561; 2,702,893; 3,061,716; 3,997,225; 4,085,996; 4,934,962; 2,706,225; 3,484,735; 3,525,971; 4,934,962; and 5,122,082.

In a tap of the type illustrated in U.S. Pat. Nos. 4,934,962 and 5,122,082, the electrical contacts are formed by pods assembled in the housing or on the back plate. Each pod contains multiple contact strips which must be individually wired with the appropriate prong. Moreover, each strip must include a contact blade located in the pod to facilitate electrical connection. The assembly operation includes several soldering operations and numerous other operations involving the correct placement of subassemblies into the current tap housing before and during final assembly. As a result, the labor cost associated with manufacturing such taps is relatively high. This assembly cost is associated with each tap, making the purchase price of such taps higher than it would be if another suitable design could be developed.

SUMMARY OF THE INVENTION

It is an object of the present invention to provide a multiple outlet electrical adapter having components which are quickly and easily assembled in the housing, with minimal connection points, thus avoiding high assembly costs.

Another object of the present invention is to minimalize the amount of material used to produce the conductive elements of the electrical adapter. Yet another object of the present invention is to provide a configuration for an electrical adapter with sufficient spacing between conductive elements to avoid the need for insulating material.

According to the present invention, an adapter for converting a single electrical outlet into a multiple electrical outlet comprises a housing having a front and a back, and two opposed sides extending between the front and back. At least one socket is located on each of the sides. Each socket includes a live prong receiving aperture and a neutral prong receiving aperture.

An electrically conductive live bus is disposed in the housing and includes a first live prong capable of being inserted into a live aperture in an electrical outlet receptacle. The live bus comprises a pair of electrically conductive live bus strips, each of which extends along one of the two opposed sides of the adapter and adjacent the live prong receiving aperture of the at least one socket, to electrically conductively engage a second live prong inserted into the live prong receiving aperture.

An electrically conductive neutral bus is disposed in the housing and includes a first neutral prong capable of being inserted into a neutral aperture of the electrical outlet receptacle. The neutral bus comprises a pair of electrically conductive neutral bus strips, each of which extends along one of the two opposed sides of the adapter and adjacent the neutral prong receiving aperture of the socket to electrically conductively engage a second neutral prong inserted into the neutral prong receiving aperture.

Advantageously, the live and neutral bus strips are each formed of a single piece of metal, preferably brass/copper, in a configuration which minimizes the amount of metal and the number of connection points required.

Additionally, advantageously, the live and neutral strips are configured such that the first live prong and first neutral prong are properly aligned to fit into an electrical outlet, but the strips are offset vertically so as to maintain sufficient clearance to avoid the need for electrical insulation.

Other features and advantages of the present invention will become apparent from the following description of the invention which refers to the accompanying drawings.

BRIEF DESCRIPTION OF THE DRAWINGS

FIG. 5 illustrates a profile of a flat strip which can be formed into the configurations of both the live and neutral first bus strips of the adapter of FIG. 1;

FIG. 6 illustrates a profile of a flat strip which can be formed into the live prong, or second live bus strip, of the adapter of FIG. 1;

FIG. 7 illustrates a profile of a strip which can be formed into the neutral prong, or second neutral bus strip, of the adapter of FIG. 1;

FIG. 8 illustrates a profile of a flat strip which can be formed into either of the first ground bus strips of the adapter of FIG. 1; and FIG. 9 illustrates a profile of a flat strip which can be formed into the ground prong, or second ground bus strip, of the adapter of FIG. 1.

DETAILED DESCRIPTION OF THE INVENTION

Figure 1:
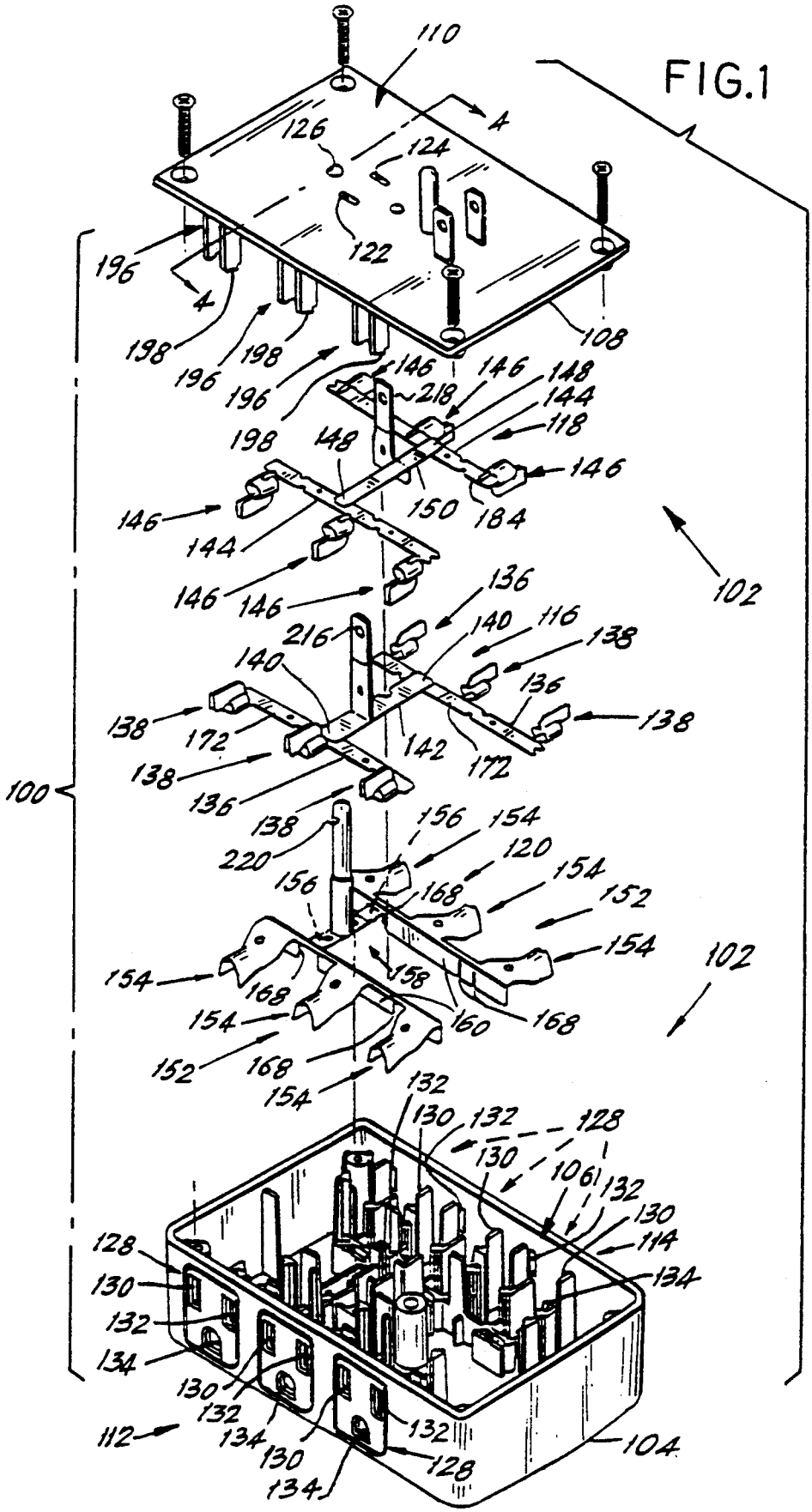
FIG. 1 illustrates a perspective view of a single-to-multiple electrical outlet adapter constructed according to the present invention.

In its preferred embodiment, the present invention, a single-to-multiple electrical outlet adapter or tap 100, includes a housing 102 having a front 104, the inside 106 of which is presented to the viewer in FIG. 1. A back 108, the outside 110 of which is presented to the viewer in FIG. 1, and two sides 112, 114, with the outside of side 112 and the inside of side 114 being presented to the viewer in FIG. 1, complete the adapter.

Adapter 100 also includes a live bus assembly 116, a neutral bus assembly 118 and a ground bus assembly 120. Each of the live, neutral and ground bus assemblies 116, 118, 120, respectively, includes a prong configured for passage through an opening 122, 124, 126, respectively, provided therefor on back 108 for plugging into an electrical outlet, such as a residential 110 VAC, 60 Hz outlet. As is well known in the art, AC outlets typically include a "live" terminal which carries the sinusoidal alternating voltage and is adapted to receive the "live" prong of an electrical device, a "neutral" terminal which carries a constant, reference voltage level, preferably close to the ground voltage level and is adapted to receive the "neutral" prong of an electrical device, and optionally a "ground" terminal which is electrically connected to ground voltage level and is adapted to receive an optional "ground" prong of an electrical device. Live bus assembly 116 includes a live prong 220, neutral bus assembly 118 includes prong 218 and ground bus assembly 120 includes a ground prong 220.

Each of the sides 112, 114 is provided with a plurality of sockets 128, with three such sockets being illustrated in FIG. 1. Each socket 128 includes a live prong-receiving aperture 130, a neutral prong-receiving aperture 132 and a ground prong-receiving aperture 134.

The live bus assembly 116 comprises a pair of respective electrically conductive first live bus strips 136 extending along each side 112, 114 of the housing 102. The profile of each first live bus strip 136 before it is formed into shape is best illustrated in FIG. 5. During assembly, each first live bus strip 136 is positioned adjacent each socket 128 in the region directly behind the live prong-receiving aperture 130 to electrically conductively engage a live prong inserted into one of the live prong-receiving apertures 130 to connect the inserted live prong electrically to the live bus assembly 116. The respective first live bus strips 136 themselves are stamped from a sheet of electrically conductive material, typically a resilient brass/copper alloy. The strips are configured to minimize the amount of wasted metal. Spring ends 138 are bent to form grippers which securely grip the live prongs of appliances and the like inserted into the live prong-receiving apertures 130.

The two electrically conductive first live bus strips 136 are joined about midway along their lengths, for example, by spot welding the strips to the ends 140 of a electrically conductive second live bus strip 142. The profile of the second live bus strip 142, and how it is formed into a component of the live bus assembly 116 can best be appreciated by comparing FIGS. 1 and 6. As can be seen from FIG. 6, strip 142 is stamped from a single piece of brass/copper metal in a configuration which minimizes wastage of metal and minimizes connection points, as discussed below. During assembly, strip 142 is folded along the dashed lines to form prong 216 and ends 140.

The neutral bus assembly 118 comprises an electrically conductive first neutral bus strip 144 extending along each side 112, 114 of the housing 102. The profile of the strip of material from which each first neutral bus strip 144 is formed is best illustrated in FIG. 5. Each first neutral bus strip is formed adjacent each socket 12 in the region directly behind the neutral prong-receiving aperture 132 to electrically conductively engage a neutral prong inserted into one of the neutral prong-receiving apertures 132 to connect the inserted neutral prong electrically to the neutral bus assembly 118. The first neutral bus strips 144 are formed with spring ends 146 which securely grip the neutral prongs inserted into the neutral prong-receiving apertures 132. Like spring ends 138 of first live strip 136, ends 146 are stamped in a flat shape, and subsequently bent to form grippers.

The two electrically conductive first neutral bus strips 144 are joined about midway along their lengths, for example, by spot welding them to the ends 148 of an electrically conductive second neutral bus strip 150. The profile of the second neutral bus strip 150, and how it is formed into a component of the neutral bus assembly 118 can best be appreciated by comparing FIGS. 1 and 7. As shown in FIG. 7, prong 218 and ends 148 are stamped from a single piece of metal and bent along the dashed lines to form the strip 150. The single piece configuration of the second neutral bus strip 150 minimizes the amount of brass or copper material used to make the strip, greatly decreasing waste, and also advantageously minimizes connection points. Thus, as shown in FIG. 1, each first live strip 136 and each first neutral strip 144 are spot welded to the respective second live bus strip 142 and second neutral strip 150 at a single location.

Figure 2:
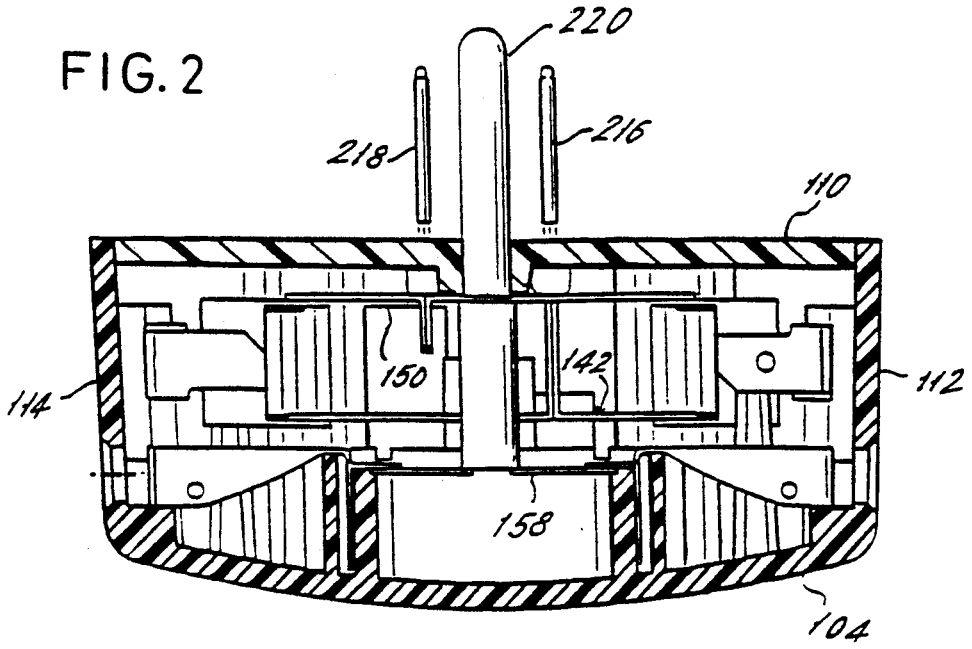
FIG. 2 illustrates a plan view of a portion of the housing illustrated in FIG. 1, including the inside of the housing front.

The second live bus strip 142 and the second neutral bus strip 150 are configured such that the respective prongs 216, 218 are aligned with one another when the adapter is assembled, as shown in FIG. 2. However, strips 142, 150 have different lengths, such that the first live and neutral bus strips 136, 144 each lie in a different vertical plane (again, see FIG. 2) to maintain a clearance therebetween, thus avoiding the need for insulating parts.

The ground bus assembly 120 comprises an electrically conductive first ground bus strip 152 extending along each side 112, 114 of the housing 102. The profile of the strip of material from which each first ground bus strip 152 is formed is best illustrated in FIG. 8. Each first ground bus strip is formed adjacent each socket 128 in the region directly behind the ground prong-receiving aperture 134 to electrically conductively engage a ground prong inserted into one of the ground prong-receiving apertures 134 to connect such a prong electrically to the ground bus assembly 120. The first ground bus strips 152 are formed with spring ends 154 for securely gripping the ground prongs of appliances and the like inserted into the ground prong-receiving apertures 134. As illustrated by FIGS. 1 and 8, the spring ends 154 are bent along the dashed line and then curved annularly to form the gripping portion for the ends.

The two electrically conductive first ground bus strips 152 are joined along their lengths, illustratively by spot welding them to the ends 156 of an electrically conductive second ground bus strip 158. The profile of the second ground bus strip 158, and how it is formed into a component of the ground bus assembly 120 can best be appreciated by comparing FIGS. 1 and 9. As shown in the Figures, ends 156 are bent along the dash lines and the prong 220 is formed by curving the upper flat section in FIG. 9.

Figure 3:
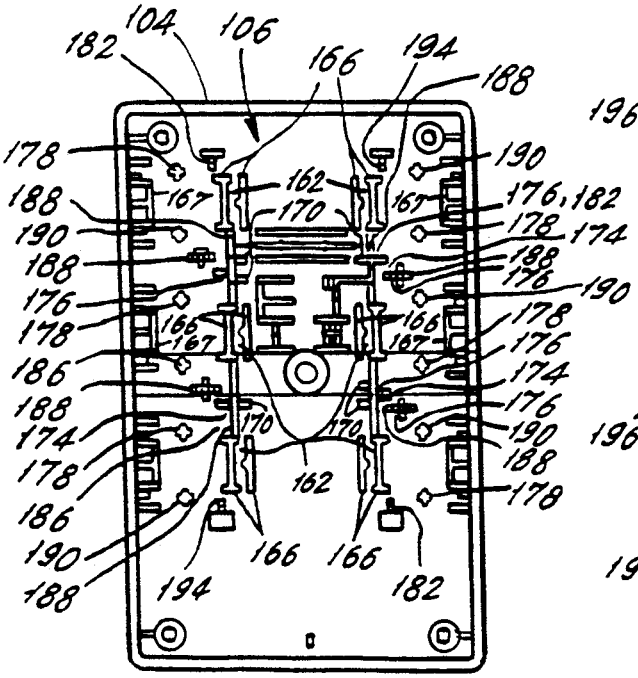
FIG. 3 illustrates a plan view of a portion of the housing illustrated in FIG. 1, including the inside of the housing front.
Figure 4:
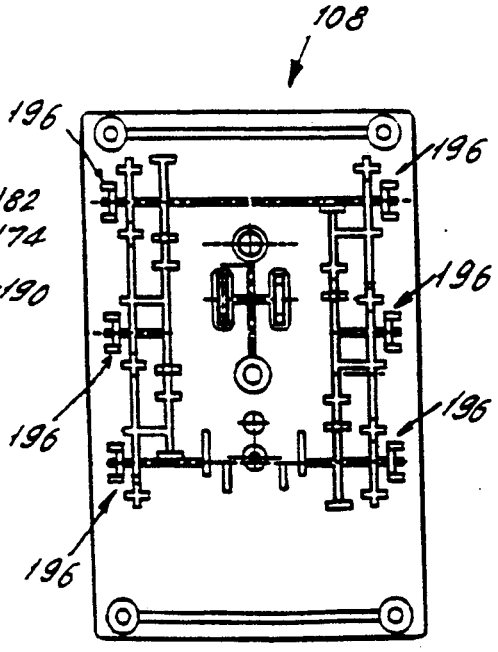
FIG. 4 illustrates a plan view of the back of the housing illustrated in FIG. 1.

With particular reference now to FIGS. 1 and 3, it will be appreciated that the inside 106 of the front 104 is formed with a plurality of upstanding spacers, guides and retainers to guide the live, neutral and ground bus assemblies 116, 118, 120, respectively, into their assembled orientations in the adapter, to retain the bus assemblies in these orientations and to position the bus assemblies within the housing 102 in a spaced-apart orientation with each other to maintain insulated electrical integrity therebetween. For example, the "backbones" 160 of strips 152 of the ground bus assembly are press-fitted into slots 162 provided between adjacent upstanding ribs 166 which project rearwardly from the inside 106 of the housing front 104. When the ground bus assembly 120 is in the assembled configuration, the spring ends 154 of strips 152 rest against ribs 167 adjacent the ground prong-receiving apertures 134. The cut-out regions 168 of strips 152 cooperate with guides 170 formed on the inside 106 of the front 104 to guide the ground bus assembly 120 into the front 104 of housing 102.

The backbones 172 of strips 136 of the live bus assembly 116 are press-fitted into slots 174 provided therefor between adjacent upstanding ribs 176 which project rearwardly from the inside 106 of front 104 of the housing. When the live bus assembly 116 is in the assembled configuration, the spring ends 138 of strips 136 rest against ribs 178 adjacent the live prong-receiving apertures 130. The cut-out regions 180 of strips 136 cooperate with guides 182 formed on the inside 106 of housing front 104 to guide the live bus assembly 116 into front 104.

The backbones 184 of strips 144 of the neutral bus assembly 118 are press-fitted into slots 186 provided therefor between adjacent upstanding ribs 188 which project rearwardly from the inside 106 of the front 104. When the neutral bus assembly 118 is in the assembled configuration, the spring ends 146 of strips 144 rest against ribs 190 adjacent the neutral prong-receiving apertures 132. The cut-out regions 192 of strips 144 cooperate with guides 194 formed on the inside 106 of front 104 to guide the neutral bus assembly 118 into front 104.

The inside of back 108 is provided with upstanding ribs 196 which project into the inside 106 of the front 104 when the housing 102 is assembled. In the assembled adapter, the ends 198 of ribs 196 lie against the spring ends 154 of strips 152 of the ground bus assembly to resist deflection of ends 154 toward live and neutral buses 116 and 118. The ribs 196 also lie between the adjacent spring ends 138 of the live bus, and the spring ends of the neutral bus 146 of each socket 128 to maintain separation therebetween when the adapter is assembled.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An adapter for converting a single electrical outlet into a multiple electrical outlet, comprising:

a housing having a front and a back, and two opposed sides extending between the front and back;

at least one socket located on each of said sides, each socket including a live prong receiving aperture and a neutral prong receiving aperture;

an electrically conductive live bus disposed in said housing and having a first live prong capable of being inserted into a live aperture in an electrical outlet, said live bus including a pair of electrically conductive first live bus strips, each of said first live bus strips extending along one of said two opposed sides and adjacent said live prong receiving aperture of said socket to electrically conductively engage a second live prong inserted into said live prong receiving aperture;

an electrically conductive neutral bus disposed in said housing having a first neutral prong being capable of being inserted into a neutral aperture of the electrical outlet, said neutral bus including a pair of electrically conductive first neutral bus strips, each of said first neutral bus strips extending along one of said two opposed sides adjacent said neutral prong receiving aperture of said socket to electrically conductively engage a second neutral prong inserted into said neutral prong receiving aperture;

a first opening located in said housing through which said first live prong of said live bus projects for insertion into the live aperture of the electrical outlet; and a second opening located in the housing through which said first neutral prong of said neutral bus projects for insertion into the neutral aperture of the electrical outlet.

2. The adapter of claim 1, wherein each of said first live bus strips is formed of a single piece of material.

3. The adapter of claim 1, wherein each of said first neutral bus strips is formed of a single piece of material.

4. The adapter of claim 1, further comprising spring ends disposed on each of said first live bus strips for gripping the second live prong inserted into the live prong receiving aperture.

5. The adapter of claim 1, further comprising spring ends disposed on each of said first neutral bus strips for gripping the second neutral prong inserted into the neutral prong receiving aperture.

6. The adapter of claim 1, further comprising an electrically conductive second live bus strip for supporting said first live prong.

7. The adapter of claim 6, wherein said second live bus strip extends between and connects each of said first live bus strips.

8. The adapter of claim 6, wherein the second live bus strip is formed of a single piece of metal and is connected to said first live bus strips at a single connection point.

9. The adapter of claim 1, further comprising an electrically conductive second neutral bus strip for supporting said first neutral prong.

10. The adapter of claim 9, wherein said second neutral bus strip extends between and connects each of said first neutral bus strips.

11. The adapter of claim 9, wherein said second neutral bus strip is formed of a single piece of metal and is connected to each of said first neutral bus strips at a single connection point.

12. The adapter of claim 1, further comprising spacing means provided in said housing for spacing said live bus from said neutral bus.

13. The adapter of claim 12, wherein said spacing means comprises a plurality of ribs disposed on the front of the housing.

14. The adapter of claim 1, further comprising an electrically conductive ground bus disposed in said housing having a first ground prong capable of being inserted into a ground aperture in the electrical outlet, said socket including a ground prong receiving aperture, said ground bus comprising an electrically conductive first ground bus strip extending along each of said sides adjacent said ground prong receiving aperture to electrically conductively engage a second ground prong inserted into said ground prong receiving aperture.

15. The adapter of claim 14, further comprising a third opening in said housing, said first ground prong projecting through said third opening for insertion into the ground aperture of the electrical outlet.

16. The adapter of claim 14, further comprising spring ends disposed on each of said first ground bus strips for gripping the second ground prong inserted into the ground prong receiving aperture.

17. The adapter of claim 14 wherein said first ground bus strip is formed of a single piece of material.

18. The adapter of claim 17, wherein said second ground bus strip is formed of a single piece of material.

19. The adapter of claim 14, further comprising an electrically conductive second ground bus strip for supporting said second ground prong.

20. The adapter of claim 19, wherein said second ground bus strip extends between and connects each of said first ground bus strips.

21. The adapter of claim 14, further comprising a spacing means for spacing said ground bus from said live bus.

22. The adapter of claim 21, wherein said spacing means also spaces said neutral bus from said ground bus.

23. An adapter for converting a single electrical outlet into a multiple electrical outlet, comprising:

a housing having a front and a back, and two opposed sides extending between the front and back;

at least one socket located on one of said two sides, said socket including a live prong receiving aperture and a neutral prong receiving aperture;

an electrically conductive live bus disposed in said housing and having a first live prong capable of being inserted into a live aperture in an electrical outlet, said live bus including an electrically conductive first live bus strip, said live bus strip extending along one of said two opposed sides and adjacent said live prong receiving aperture of said socket to electrically conductively engage a second live prong inserted into said live prong receiving aperture, said first live bus strip being connected to said first live prong at a single connection point;

an electrically conductive neutral bus disposed in said housing having a first neutral prong being capable of being inserted into a neutral aperture of the electrical outlet, said neutral bus including an electrically conductive first neutral bus strip, said first neutral bus strip extending along one of said two opposed sides adjacent said neutral prong receiving aperture of said socket to electrically conductively engage a second neutral prong inserted into said neutral prong receiving aperture, said at least one first neutral bus strip being connected to said first neutral prong at one single connection point;

a first opening located in said housing through which said first live prong of said live bus projects for insertion into the live aperture of the electrical outlet; and a second opening located in the housing through which said first neutral prong of said neutral bus projects for insertion into the neutral aperture of the electrical outlet.

24. The adapter of claim 23, wherein said first live bus strip and said first neutral bus strip are each formed of a single piece of material.

25. The adapter of claim 23, wherein said live bus further comprises an electrically conductive second live bus strip extending along a second of said two opposed sides and adjacent a live prong receiving aperture of a socket on said second of said two opposed sides, said second live bus strip being connected to said first live prong of said live bus at a single connection point.

26. The adapter of claim 25, wherein said second live bus strip is formed of a single piece of metal.

27. The adapter of claim 23, wherein said neutral bus further comprises an electrically conductive second neutral bus strip extending along a second of said two opposed sides and adjacent a neutral prong receiving aperture of a socket on said second of said two opposed sides, said second neutral bus strip being connected to said first neutral prong of said neutral bus at a single connection point.

28. The adapter of claim 27, wherein said second neutral bus strip is formed of a single piece of metal.

29. The adapter of claim 23, further comprising an electrically conductive ground bus disposed in said housing having a first ground prong capable of being inserted into a ground aperture in the electrical outlet, said socket including a ground prong receiving aperture, said ground bus comprising an electrically conductive first ground bus strip extending along each of said sides adjacent said ground prong receiving aperture to electrically conductively engage a second group prong inserted into said ground prong receiving aperture.

30. The adapter of claim 29, wherein said first ground bus strip is formed of a single piece of metal.

31. The adapter of claim 29, wherein said ground bus further comprises an electrically conductive second ground bus strip extending along a second of said two opposed sides and adjacent a ground prong receiving aperture of a socket on said second of said two opposed sides, said second ground bus strip being connected to said first ground prong of said ground bus at a single connection point.

32. The adapter of claim 31, wherein said second ground bus strip is formed of a single piece of metal.

* * * * *